United States Patent [19]

Bankstahl et al.

[11] Patent Number: 5,009,621

[45] Date of Patent: Apr. 23, 1991

[54] TORQUE SPLITTING DRIVE TRAIN MECHANISM FOR A DUAL COUNTERROTATING PROPELLER MARINE DRIVE SYSTEM

[75] Inventors: Herbert A. Bankstahl, Fond du Lac; Lyle M. Forsgren, Oshkosh; Neil A. Newman, Omro; Wayne T. Beck; John M. Griffiths, both of Fond du Lac, all of Wis.

[73] Assignee: Brunswick Corporation, Skokie, Ill.

[21] Appl. No.: 326,024

[22] Filed: Mar. 20, 1989

[51] Int. Cl.[5] ..... B63H 23/28

[52] U.S. Cl. ..... 440/75; 74/665 R; 416/129; 475/248

[58] Field of Search ..... 440/75, 80, 81; 416/129, 130, 124, 128; 74/664, 665 R, 665 K; 415/61, 68; 475/248, 295

[56] References Cited

U.S. PATENT DOCUMENTS

| | | | |
|---|---|---|---|
| 1,821,450 | 9/1931 | Stelzer | 416/129 |
| 2,062,293 | 12/1936 | Cashman . | |
| 2,064,195 | 12/1936 | Michelis . | |
| 2,085,483 | 6/1937 | Trebucien | 416/129 |
| 2,170,733 | 8/1939 | Sharpe | 416/129 |
| 2,672,115 | 3/1954 | Conover | 440/80 |
| 2,765,040 | 10/1956 | Darrah | 416/129 |
| 2,987,031 | 6/1961 | Odden . | |
| 3,087,553 | 4/1963 | Kostyun | 416/129 |
| 3,356,150 | 12/1967 | Ruszczycky et al. . | |
| 3,478,620 | 11/1969 | Shimanckas . | |
| 3,646,834 | 3/1972 | Davis | 74/674 |
| 4,118,996 | 10/1978 | Eichinger | 440/75 |
| 4,540,369 | 9/1985 | Caires | 440/81 |
| 4,604,032 | 8/1986 | Brandt et al. | 416/128 |
| 4,619,584 | 10/1986 | Brandt | 416/129 |
| 4,642,059 | 2/1987 | Nohara | 440/75 |
| 4,741,670 | 5/1988 | Brandt | 416/129 |
| 4,792,314 | 12/1988 | McCormick | 440/81 |

FOREIGN PATENT DOCUMENTS

| | | | |
|---|---|---|---|
| 50425 | 3/1940 | France . | |
| 357807 | 3/1987 | Italy | 416/128 |

*Primary Examiner*—Jesus D. Sotelo

*Attorney, Agent, or Firm*—Andrus, Sceales, Starke & Sawall

[57] ABSTRACT

A dual counterrotating propeller drive mechanism for a marine propulsion system incorporates a torque splitting device which consists of a differential gear means and a ratio gear means. The torque splitting device assigns a selectable fixed fraction of the engine torque to each propeller regardless of power, thrust, and speed conditions. The rear one of the two propellers adjusts its rotational speed relative to the front propeller in response to changes in the front propeller's wake and in this way maintains optimum propulsive efficiency over a wide range of operating conditions. Furthermore, precise matching of front and rear propeller parameters for a given application is no longer required.

22 Claims, 5 Drawing Sheets

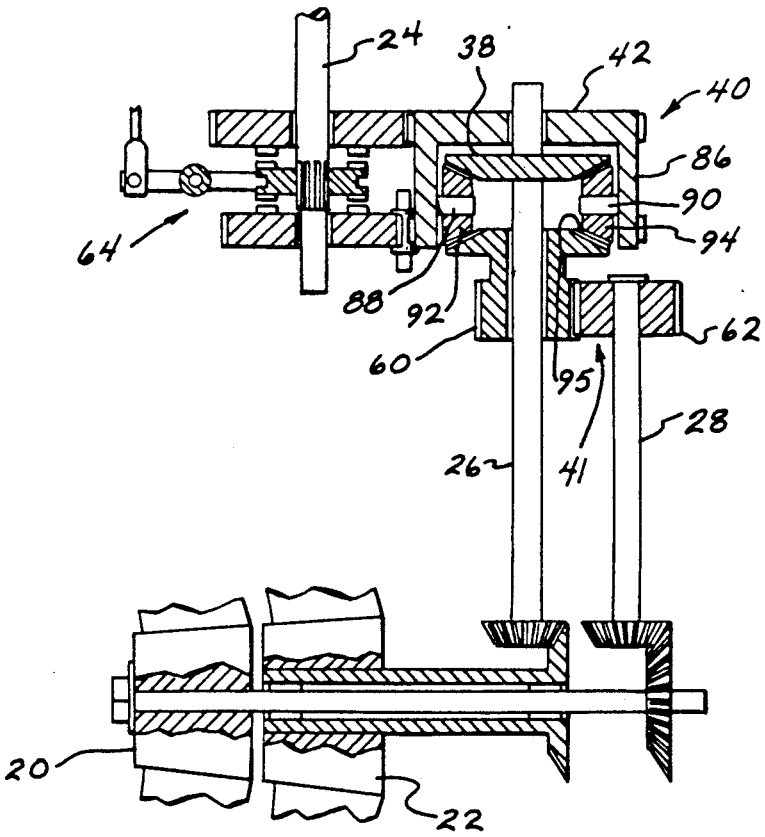
FIG. 4
FIG. 5
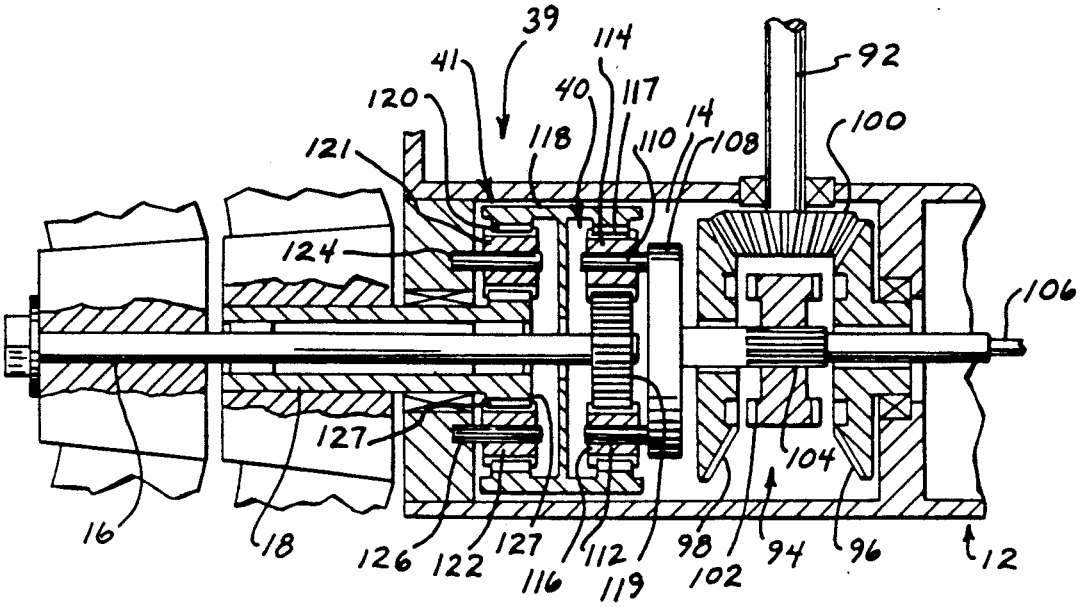

TORQUE SPLITTING DRIVE TRAIN MECHANISM FOR A DUAL COUNTERROTATING PROPELLER MARINE DRIVE SYSTEM

BACKGROUND AND SUMMARY

This invention relates to a marine propulsion system, and more particularly to such a system incorporating dual counterrotating propellers.

In a marine propulsion system, it is known to employ dual counterrotating propellers for driving a boat. The propellers are oppositely pitched, so that rotation of each propeller provides forward thrust to the boat. Employment of counterrotating propellers offsets torque imbalances which result from the use of a single propeller and improves system efficiency particularly at high speeds and high thrust.

Current practice in designing a dual counterrotating propeller system provides a driving connection between the engine and two concentric propellers which typically employs a fixed drive ratio to each propeller. In such a system, the propellers rotate at equal rotational speeds.

The above-noted design results in operating inefficiencies. For example, the forward one of the two propellers accelerates the water in its path in a helical direction, as all screw propellers do. The amount of helical motion imparted to the water depends on the state of thrust and speed of the propeller at any moment. Whereas the forward propeller operates on relatively undisturbed .water with no rotational movement, the rear propeller runs in the wake of the forward propeller, facing various degrees of rotation and velocity of the water exiting the forward propeller.

To deal with this problem, current practice matches the propeller pitches and diameters and sometimes blade areas to optimize the system efficiency at a selected operating condition. But because boat weight, engine power setting, and operating speed are not within the control of the propeller designer, the propeller match will rarely produce optimum results. One way to refine this approach is shown in Brandt U.S. Pat. No. 4,741,670, which incorporates supercavitating operation in the rear propeller. This system provides improved operation due to the flatter torque to slip relationship of a supercavitating propeller versus a standard propeller. However, the supercavitating propeller efficiency is typically lower than that of a standard propeller at moderate speeds. Furthermore, as operating conditions deviate from the optimal design conditions, some deterioration of efficiency will still occur because of the inability of the rear propeller to change pitch or rotational speed relative to the forward propeller.

The object of this invention is to allow the propellers in a dual propeller installation to deal with the variable, rotational motion and speed of water in the wake of the forward propeller without reference to a selected design condition. As mentioned earlier, a variable adjustment of either pitch or rotational speed of the rear propeller will produce the desired matching of propeller parameters to the operating conditions. Because of the mechanical complexity in the confined space of a propeller hub, the pitch adjustment has been rejected in favor of a rotational speed adjustment which may be accomplished away from the submerged parts of the drive unit.

The essence of the invention is a torque splitting device between the engine output shaft and the propellers which forces a selectable fixed fraction of the engine torque to be transmitted to each propeller regardless of engine power, thrust requirement, or boat speed. The rotational speed of each propeller is allowed to adjust relative to the other propeller through a differential device operationally analagous to an automotive differential gear. Any change in operating conditions at one propeller that causes an increase or decrease of torque allows the forward propeller to slow down or speed up as required by such conditions, causing a corresponding speed-up or slow down in the rotational speed of the second propeller, which results in an increase or decrease of torque in the second propeller until the torque balance is reestablished. This way a precise matching of front and rear propeller parameters is no longer required. Each propeller will provide its assigned share of thrust under all conditions, resulting in optimized system efficiency for a wide range of operating conditions. In addition, the portion of thrust assigned to each propeller is selectable as a result of this invention.

In a typical dual propeller counterrotation marine drive system, the front and rear propellers are each mounted to a propeller shaft, with the respective propeller shafts being rotatably mounted in the lower portion of the marine drive unit housing. The propeller shafts are preferably coaxially mounted within a torpedo formed in the lower portion of the drive unit housing. The torque splitting device of the invention is drivingly interconnected between the propeller shafts and the engine crankshaft. In one embodiment, the marine drive system includes a pair of drive shafts rotatably mounted in the drive unit housing, with each of the drive shafts being drivingly connected to one of the propeller shafts. The torque splitting device is interconnected with the drive shafts so as to provide an adjustment to the relative rotational speed of each drive shaft in response to propeller operating conditions. With this arrangement, the drive shafts extend upwardly above the waterline during boat operation, and the compensating gear means can likewise be disposed above the waterline so as not to effect the frontal area of the submerged portion of the drive unit. A reversing transmission may then also be disposed above the waterline. In another embodiment of the invention, the torque splitting device is housed within the torpedo between an input shaft, driven in response to the engine crankshaft, and the propeller shafts.

In each of the above embodiments, the torque splitting device includes counterrotation drive means which imparts counterrotation to the propeller shafts, and thereby to the propellers. The torque splitting device accomplishes its objective by providing two or more drive pinions mounted to a carrier member, which is adapted to be driven in response to rotation of the engine crankshaft. The drive pinions generally comprise two or more gears rotatably mounted to two or more pins mounted to the carrier member. The two or more drive pinions are interconnected with first and second driven gears, which are drivingly connected to first and second drive shafts. The counterrotation drive means may be located at any satisfactory location in the drive train to ultimately impart counterrotation to the concentric propeller shafts. During normal operation, the drive pinions do not rotate about the pins to which they are mounted. However, when operating conditions vary, the rotational speed adjustment of one or the other of the propellers is transmitted through the gearing system so as to cause the drive pinions to rotate about the pins to which they are mounted. This rotation of the drive pinions is transmitted to the driven gears so as to cause an increase or decrease in the rotational speed thereof, resulting in an increase or decrease in the speed of the propeller driven by such driven gear.

BRIEF DESCRIPTION OF THE DRAWINGS

The drawings illustrate the best mode presently contemplated of carrying out the invention.

In the drawings:

FIG. 4 is a view similar to FIG. 3 illustrating an alternate embodiment of the torque splitting drive train mechanism including a reversing transmission;

FIG. 5 is a partial side elevation view, partially in section, showing the torque splitting drive train mechanism as housed in a torpedo formed in the lower portion of the drive unit housing, and incorporating a reversing transmission;

DETAILED DESCRIPTION OF THE PREFERRED EMBODIMENT

Figure 1:
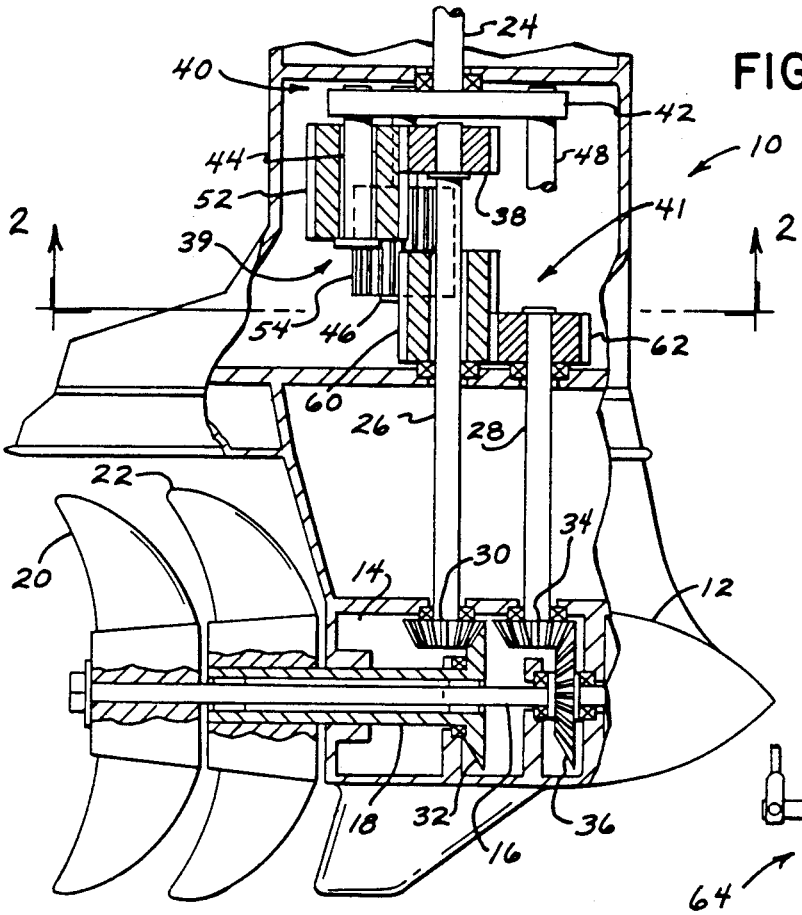
FIG. 1 is a partial side elevation view, partially in section, showing an embodiment of the torque splitting drive train mechanism of the invention in which a pair of downwardly extending drive shafts are interconnected with the propeller shafts.

With reference to FIG. 1, a marine propulsion system includes a drive unit housing 10 having a torpedo 12 formed at its lower end. FIG. 1 illustrates an outboard marine propulsion system having a power head and an internal combustion engine, not shown, of conventional construction. As will be explained, however, the invention is not limited to use in an outboard system.

Torpedo 12 includes an internal cavity 14. An inner propeller shaft 16 and an outer propeller shaft 18 are rotatably mounted in the lower portion of drive unit housing 10, and each includes a portion extending into cavity 14. As shown, a portion of the length of inner propeller shaft 16 is disposed within outer propeller shaft 18, and propeller shafts 16, 18 extend coaxially. Inner propeller shaft 16 has a rear propeller 20 mounted to its outer end, and outer propeller shaft 18 has a front propeller 22 mounted to its outer end. As shown, front and rear propellers 20, 22 are mounted adjacent to each other. Propellers 20, 22 are oppositely pitched, so that when inner and outer propeller shafts lo, 18 counterrotate, as will be explained, propellers 20, 22 simultaneously provide forward thrust.

A rotatably mounted power shaft 24 extends downwardly within drive unit housing 10. Power shaft 24 is adapted to be driven in response to rotation of the engine crankshaft (not shown), which may be disposed either vertically in an outboard configuration, as shown, or horizontally in a stern drive configuration.

A pair of downwardly extending drive shafts 26, 28 are rotatably mounted in drive unit housing 10 below power shaft 24 and above propeller shafts 16, 18. As shown in FIG. 1, drive shaft 26 has a bevel gear 30 mounted at its lower end, which is engageable with a bevel gear 32 fixed to the inner end of outer propeller shaft 18. Likewise, drive shaft 28 has a bevel gear 34 fixed to its lower end, which is engageable with a bevel gear 36 mounted to the inner end of inner propeller shaft 16. A first sun gear 38 is fixed to the upper end of drive shaft 26.

The torque splitting means of the invention is illustrated generally at 39. As shown in FIG. 1, drive shafts 26, 28 each extend upwardly within drive unit housing 10 so that their upper ends are disposed above the waterline during boat operation. With this construction, torque splitting means 39 is also located above the waterline, and the frontal area of the portion of drive unit housing 10 which encloses torque splitting means 39 does not increase the frontal area of the submerged portions of drive unit housing 10, which may otherwise result in increased drag provided by such components during operation.

Torque splitting means 39 includes a differential gear means 40 and a ratio gear means 41.

Figure 2:
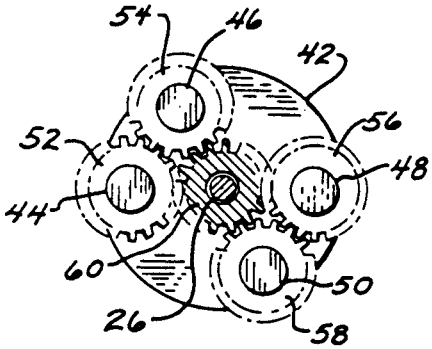
FIG. 2 is a partial sectional view taken generally along line 2—2 of FIG. 1.

Differential gear means 40 is of the epicyclic type and generally includes a planet carrier member 42 fixed to the lower end of power shaft 24, to which a plurality of drive pins 44, 46, 48 (FIG. 1) and 50 (FIG. 2) are mounted. Each of pins 44–50 has a planet pinion 52, 54, 56 and 58, respectively, mounted for free rotation thereto. As can be seen in FIGS. 1 and 2, planet pinions 52–58 are arranged in pairs, with the two planet pinions in each pair arranged in a staggered relationship. As shown in FIG. 1, planet pinion 52 has its upper end closely adjacent the lower face of planet carrier member 42, while planet pinion 54 has its upper end spaced sufficiently below the lower face of planet carrier member 42 so as to insure that there is no engagement of planet pinion 54 with first sun gear 38. As shown, planet pinion 52 engages first sun gear 38 and planet pinion 54. Planet pinions 56 and 58 are arranged similarly to planet pinions 52 and 54, with planet pinion 56 engaging first sun gear 38 and planet pinion 58.

Planet pinions 54 and 58 engage a second sun gear 60, which is mounted for free rotation about drive shaft 26 and which has the same number of teeth as first sun gear 38. Second sun gear 60 meshes with and drives a ratio gear 62 which is fixed to the upper end of drive shaft 28.

Ratio gear means 41 is comprised of the lower portion of second sun gear 60 and ratio gear 62. The drive ratio of second sun gear 60 and ratio gear 62 defines the fraction of torque in power shaft 24 that is selectively assigned to each of drive shafts 26 and 28, and thereby to propellers 22 and 20, respectively. For example, if ratio gear 62 has 27 teeth and second sun gear 60 has 23 teeth, then torque is assigned in the proportion of 27:23 to shafts 28 and 26, which translates to a 54% to 46% torque split. That is, 54% of torque goes to drive shaft 28 and 46% of torque goes to drive shaft 26. This is because the torque in sun gears 60 and 38 is equal due to the differential action and the equal numbers of teeth on sun gears 60 and 38.

Alternate ways of torque assignment are possible by selecting different numbers of teeth for sun gears 38 and 60 or by using different bevel gear ratios at the lower ends of drive shafts 26 and 28.

In operation, rotation of power shaft 24 is transmitted to sun gears 38 and 60 through differential means 40 as is known. Sun gear 38 drives propeller 22, and sun gear 60 drives propeller 20 through ratio gear 62.

If conditions at the propellers are such that one propeller needs to slow down relative to the other in order to maintain torque balance, then differential means 40 reacts to cause an increase in speed for the other propeller due to rotation of planet pinions 52–58 about drive pins 44–50, respectively, until the torque balance is reestablished.

Figure 3:
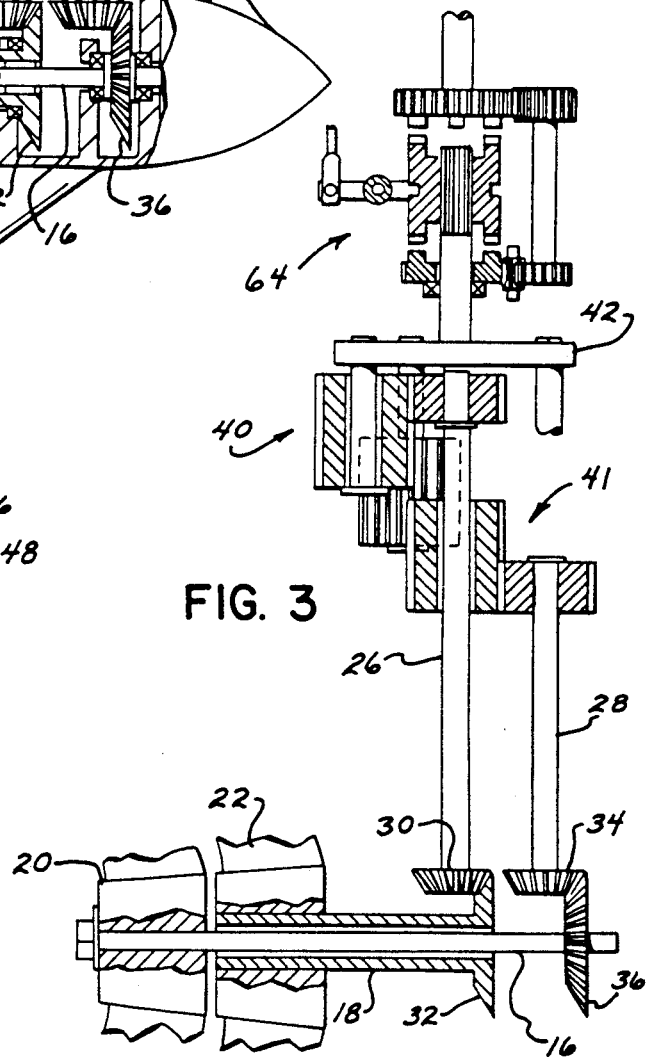
FIG. 3 is a partial side elevation view, partially in section, showing a drive mechanism similar to that shown in FIG. 1 and incorporating a reversing transmission.

FIG. 3 illustrates the drive train assembly of FIG. 1, and incorporates a reversing transmission, shown generally at 64. Transmission 64 is interposed between power shaft 24 and planet carrier member 42 so as to provide rotation of planet carrier member 42 in a selected direction, thereby controlling directional operation. Transmission 64 is of the jaw clutch type, the construction of which is known in the industry. This type of reversing transmission is illustrated as an example, and any other satisfactory reversing mechanism may be employed in its place.

FIG. 4 illustrates an alternate embodiment of the drive train mechanism as shown in FIGS. 1 and 3. Where possible, like reference characters will be used to facilitate clarity. In the embodiment of FIG. 4, the differential means 40 is of the bevel gear type as is known, and somewhat akin to an automotive differential drive. Carrier member 42 has an inverted cup shape in cross section, including an essentially cylindrical housing 86. Drive pins 88, 90 extend inwardly from housing 86 and differential pinions 92, 94 are connected for free rotation to drive pins 88, 90. In this embodiment, first differential gear 38 is in the form of a bevel gear, and second differential gear 60 likewise includes an upper bevelled surface, shown at 95. Differential pinions 92, 94 are also in the form of bevel gears, engaging the bevelled surfaces of first differential gear 38 and second differential gear 60. Rotation of carrier member 42 is transmitted through drive pins 88, 90 and differential pinions 92, 94 to first differential gear 38 and through second differential gear 60 to ratio gear 62. This construction provides counterrotation of drive shafts 26, 28, and thereby counterrotation of propellers 20, 22. Again, rotation of pinions 92, 94 on pins 88, 90 allows the rotational speed of propellers 20, 22 to be adjusted according to varying operating conditions.

In the embodiment of FIG. 4, reversing transmission 64 is placed alongside carrier member 42.

FIG. 5 illustrates an embodiment of the invention in which torque splitting means 40 is disposed within cavity 14 formed in torpedo 12. In this embodiment, an input shaft 92 is adapted to rotate in response to rotation of the engine crankshaft through appropriate gearing or the like. A conventional reversing transmission, shown at 94, is also housed within cavity 14 and includes a forward bevel gear 96 and a reverse bevel gear 98, each of which is engageable with a bevel pinion 100 mounted to the lower end of input shaft 92. A sleeve 102 is splined to a transmission shaft 104, and is slidable thereon by actuation of a clutch rod 106 through a shifting mechanism (not shown) of conventional construction. As is known, this construction allows selective engagement of teeth provided on sleeve 102 with toothed faces provided on forward and reverse gears 96, 98 to control operational direction. In this embodiment both the differential gear means 40 and the ratio gear means 41 are of the epicyclic type.

A differential planet carrier 108 is mounted to the rear end of transmission shaft 104. Carrier 108 has a pair of pins 110, 112 mounted thereto and extending rearwardly therefrom, to which a pair of differential pinions 114, 116 are rotatably mounted. Differential pinions 114, 116 each engage a forwardly disposed series of inwardly extending teeth 117 provided about the inner periphery of a ring gear 118. Differential pinions 114, 116 also engage a forward sun gear 119 fixed to the inner end of inner propeller shaft 16. Ring gear 118 has a rearwardly disposed series of inwardly extending teeth 120, which are engaged by a pair of planet pinions, shown at 121, 122 mounted to a pair of pins 124, 126, respectively, fixed to the rear wall of cavity 14. Planet pinions 121, 122 also engage a rear sun gear 127 fixed to the inner end of outer propeller shaft 18.

With the construction shown in FIG. 5, rotation of planet carrier 108 is transferred through drive pins 110, 112 and differential pinions 114, 116 to cause rotation of forward driven gear 119, thereby causing rotation of inner propeller shaft 16 in a first rotational direction. Simultaneously, differential pinions 114, 116 cause ring gear 118 to rotate. Such rotation of ring gear 118 is transferred through teeth 120 and planet pinions 121, 122 to rear driven gear 127 provided on outer propeller shaft 18, to cause rotation of outer propeller shaft 18 in a rotational direction opposite that of inner propeller shaft 16. When necessary to adjust the rotational speed of propellers 20, 22 according to operating conditions, differential pinions 114, 116 rotate on drive pins 110, 112, respectively, so as to provide an increase or decrease in propeller speed as required to ensure that proper torque is transmitted to each propeller.

The embodiment of the invention shown in FIG. 5 typically provides an increased ratio between the clutch and the propellers.

Figure 6:
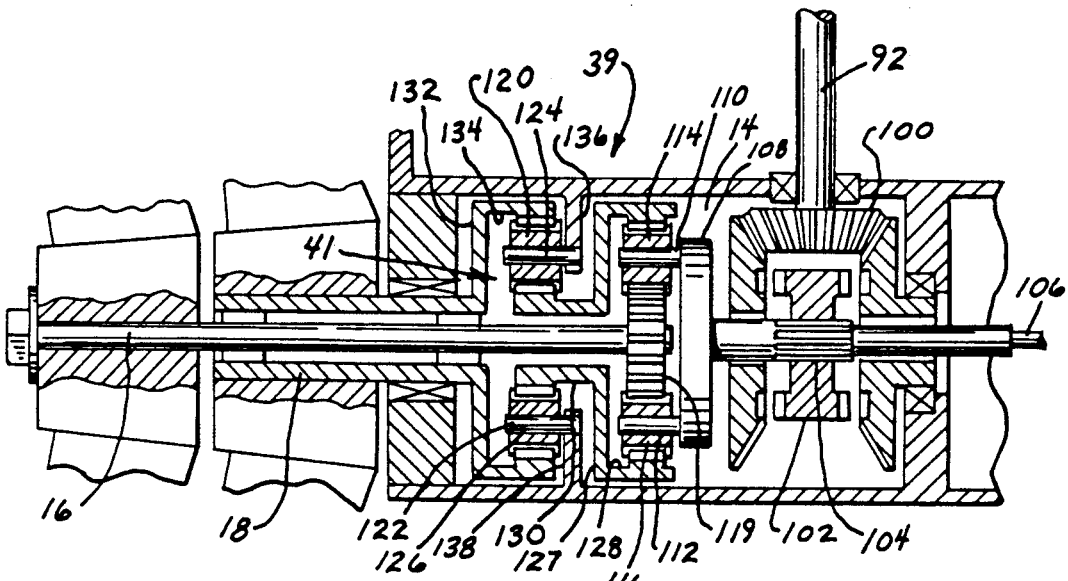
FIG. 6 is a view similar to FIG. 5, showing an alternate embodiment for the torque splitting drive train mechanism of the invention housed in the torpedo.

FIG. 6 shows an alternate embodiment for placing torque spitting means 39 within cavity 14, again employing epicyclic differntial means 40 and ratio gear means 41. Again, like reference characters will be used where possible to facilitate clarity. In the embodiment of FIG. 6, a rotatable drum member 127 includes an inner toothed face 128 and an outer toothed face 130. Inner toothed face 128 has a series of inwardly extending teeth engageable with differential pinions 114, 116, while outer toothed face 130 has a series of outwardly extending teeth engageable with planet pinions 120, 122. In this embodiment, outer propeller shaft 18 is provided at its inner end with a ring gear 132 including an inner toothed face 134 engageable with planet pinions 120, 122. Planet pins 124, 126 are mounted to inwardly extending planet carrier members 136, 138 extending inwardly from the side wall of cavity 14. With this construction, pins 124, 126 extend substantially parallel to the longitudinal axis of propeller shafts 16, 18. In operation, the embodiment of FIG. 6 functions in a substantialy identical manner to that of FIG. 5, as explained above.

The embodiment of the invention shown in FIG. 6 typically provides a reduction ratio between the clutch and the propellers.

Figure 7:
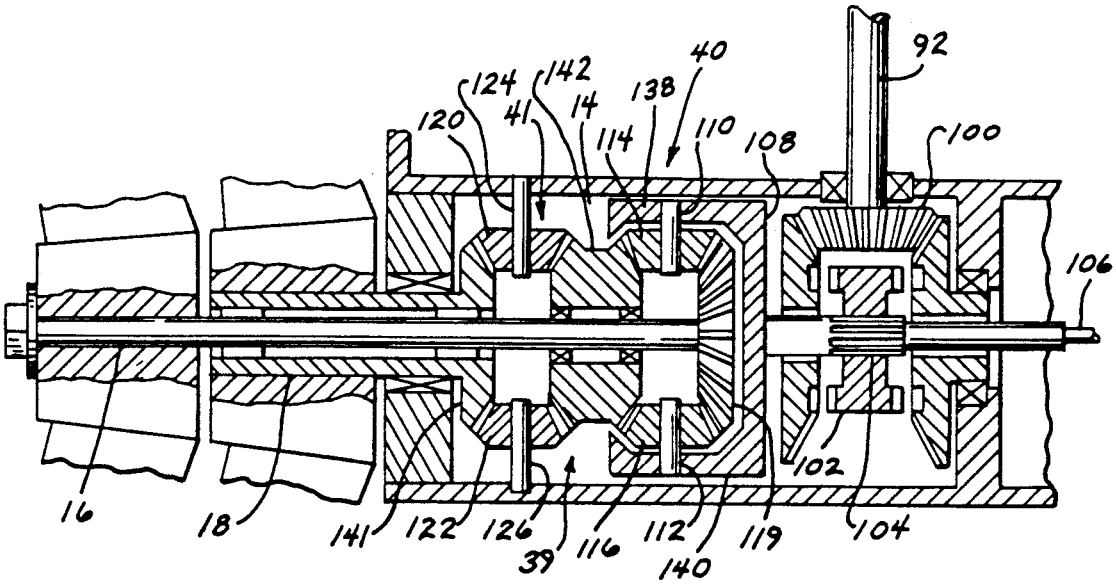
FIG. 7 is a view similar to FIGS. 5 and 6, showing yet another embodiment for the torque splitting drive train mechanism of the invention housed in the torpedo.

FIG. 7 illustrates yet another embodiment for housing torque splitting means 39 within cavity 14. In this embodiment, both the differential means 40 and the ratio gear means 41 are of the bevel gear type. Carrier member 108 is substantially C-shaped in cross section, and includes upper and lower legs 138, 140, respectively. Pinion pins 110, 112 are mounted to upper and lower legs 138, 140, respectively, and extend substantially perpendicular to the axis of inner and outer propeller shafts 16, 18. Differential pinions 114, 116 are in the form of bevel gears, as is first differential gear 119 to which the inner end of inner propeller shaft 16 is connected. A second differential gear 142 is a double faced bevel gear 142 mounted for free rotation to inner propeller shaft 16, and its forward face engages differential pinions 114, 116. The rearward face of double faced bevel gear 142 engages idler pinions 120, 122, which in this embodiment are also in the form of bevel pinions. Pins 124, 126, to which idler pinions 120, 122 are mounted, extend inwardly into cavity 14 from the side wall thereof along an axis substantially perpendicular to that of propeller shafts 16, 18. Idler pinions 120, 122 engage a bevel gear 141 mounted to the forward end of outer propeller shaft 18. With this construction, rotation of carrier 108 is transferred through drive pins 110, 112 and differential pinions 114, 116 to inner propeller shaft 16 through first differential gear 119. Simultaneously, such rotation of drive pinions 114, 116 causes rotation of double faced bevel gear 140 about its axis as defined by inner propeller shaft 16, which rotation is transferred through idler gears 120, 122 to outer propeller shaft 18. Again, the rotational speed of propellers 20, 22 is adjusted through rotation of differential pinions 114, 116 about their respective drive pins, resulting in an increase or decrease in the rotational speed of propellers 20, 22 as necessary according to operating conditions.

The embodiment of the invention shown in FIG. 7 typically provides a 1:1 ratio between the clutch and propellers.

Figure 8:
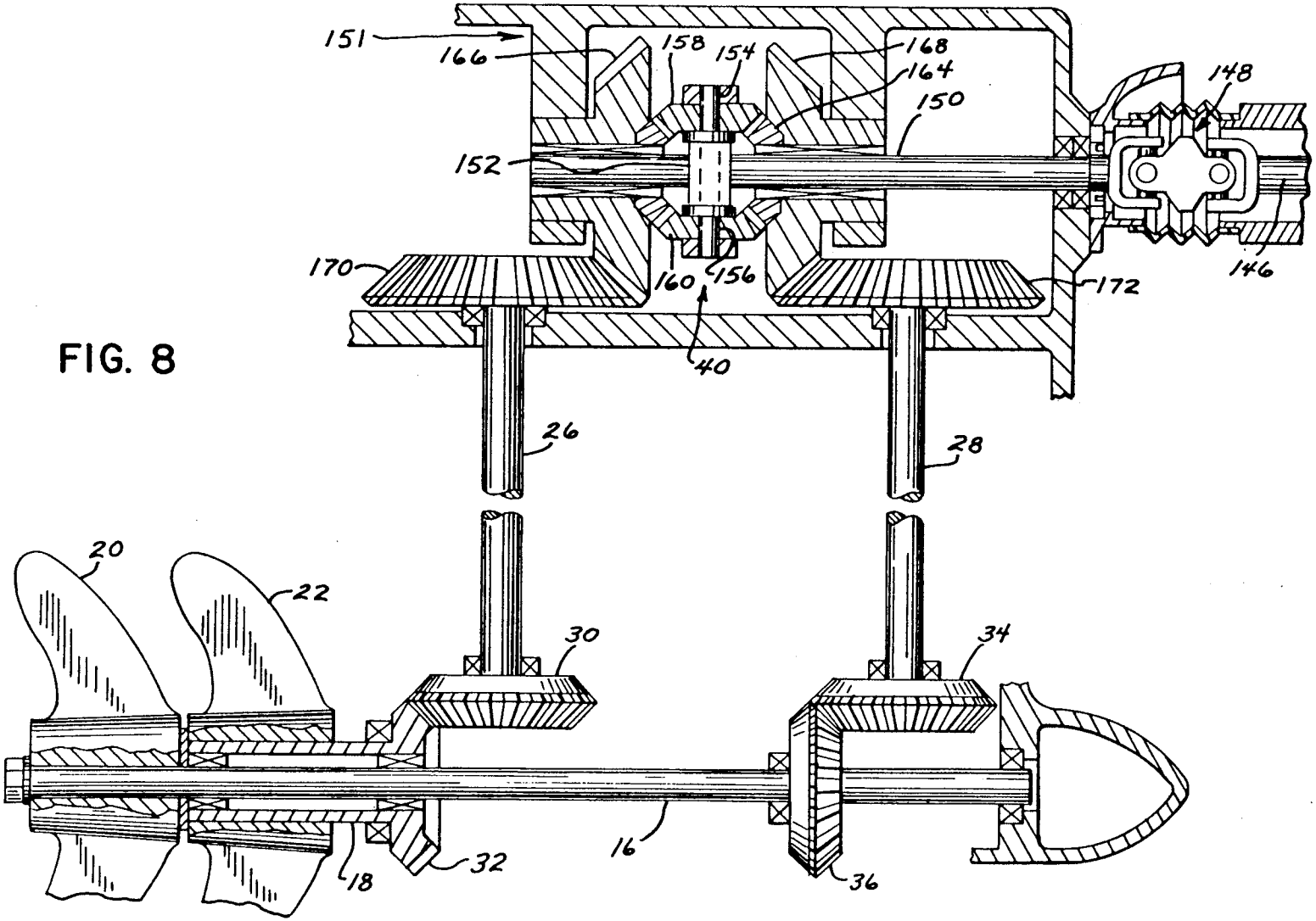
FIG. 8 is a partial side elevation view, partially in section, showing an embodiment of the torque splitting drive train mechanism suitable for use in a stern drive system.

FIG. 8 illustrates an embodiment of the invention for employment in an inboard/outboard stern drive marine propulsion system, in which the engine is mounted inboard of the boat and the drive unit mounted to the boat transom. Again, like reference characters will be used where possible to facilitate clarity. An output shaft 146 is drivingly connected with the engine crankshaft so as to be rotatable in response to rotation thereof. Output shaft 146 is connected at its rearward end to a universal joint 148, and a power shaft 150 is connected at its forward end to universal joint 148. As is known, universal joint 148 accommodates steering and tilt functions of the stern drive system. Power shaft 150 is rotatably mounted in the upper portion of a stern drive gearcase housing, shown generally at 151.

In this embodiment differential means 40 is associated with power shaft 150, and the ratio gear means is incorporated into bevel gear pairs 30, 32 and 34, 36.

A rearward bevel gear 166 is rotatably mounted to power shaft 150, as is a forward bevel gear 168. Bevel gears 166, 168 are drivingly connected to drive shaft bevel gears 170, 172, respectively, fixed to the upper ends of drive shafts 26, 28, respectively.

As shown in FIG. 8, differential means 40 is disposed between bevel gears 166 and 168, and is interconnected with power shaft 150. Differential means 40 is of the bevel gear type, and functions similarly to an automotive differential. Power shaft 150 drives a pinion carrier 152. Pinion pins 154, 156, mounted in carrier 152 carry differential pinions 158, 160 which are engaged with differential gears 162, 164. Differential gears 162, 164 drive propellers 22, 20 through upper drive pinions 166, 168, upper gears 170, 172, drive shafts 26, 28, lower pinions 30, 34, lower gears 32, 36, and outer and inner propeller shafts 18, 16, respectively. Torque splits other than 50:50 are achieved by selecting different ratios for lower gear pairs 30, 32 and 34, 36.

Operation is as described previously.

Figure 9:
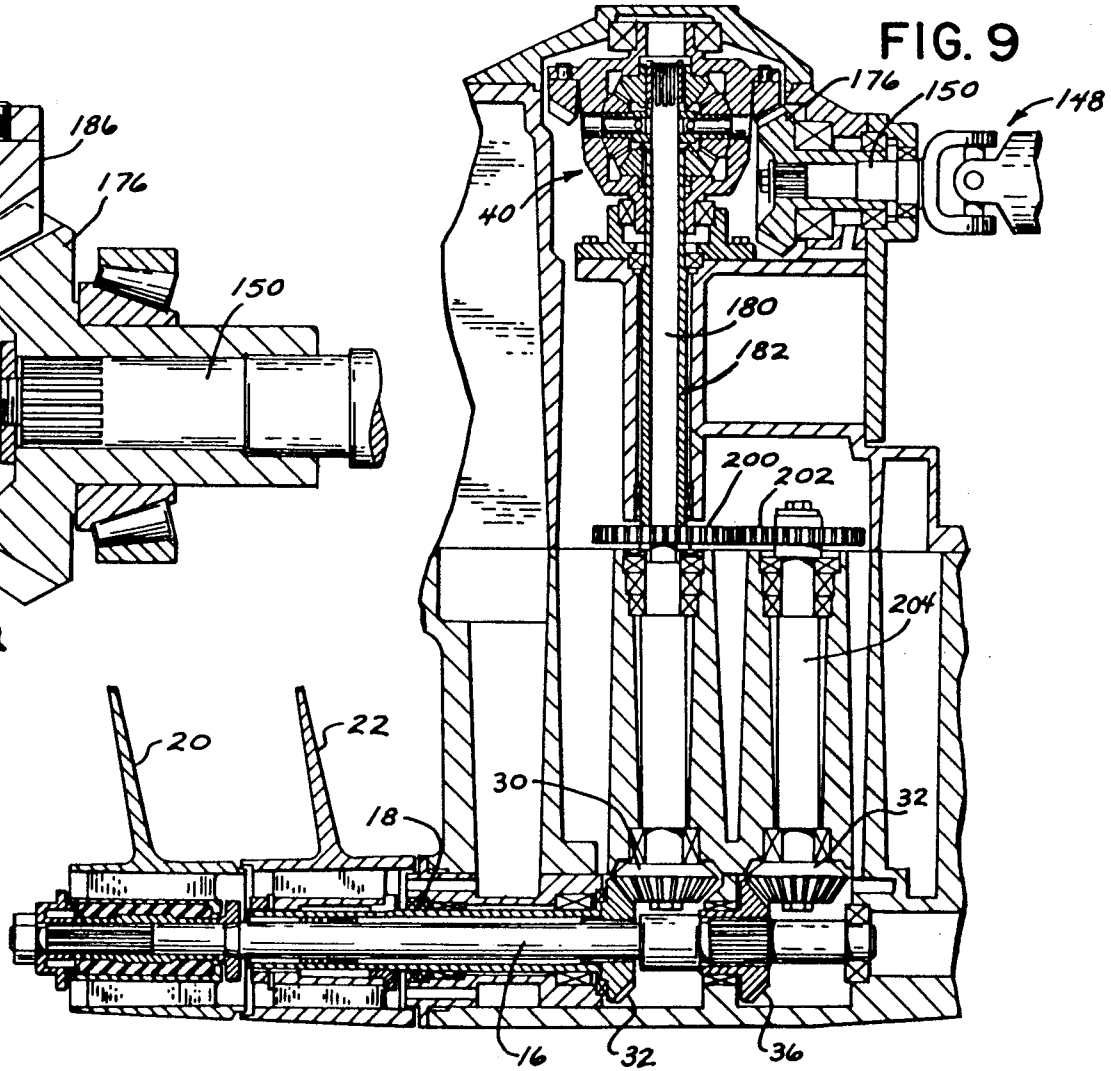
FIG. 9 is a partial sectional side elevation view showing an alternate embodiment of the torque splitting drive train mechanism suitable for use in a stern drive system.
Figure 10:
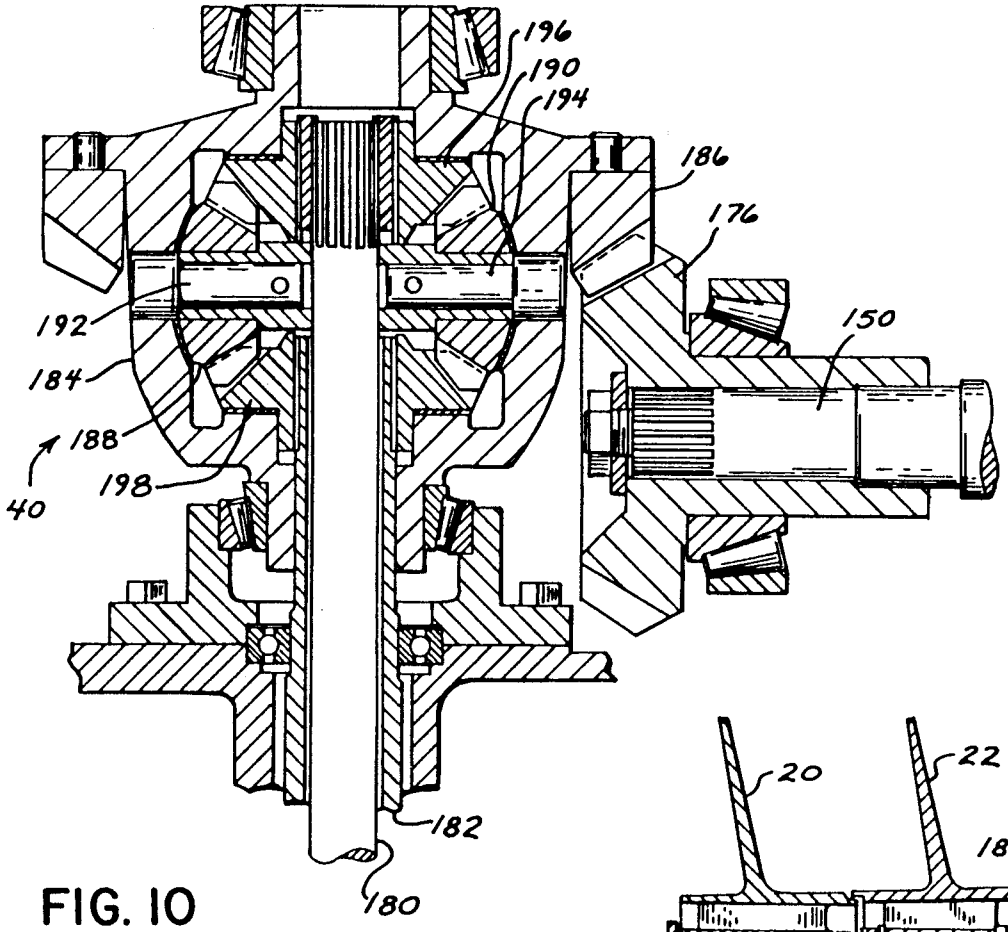
FIG. 10 is an enlarged sectional view of the torque splitting mechanism in the drive train shown in FIG. 9.

FIGS. 9 and 10 illustrate another embodiment of the invention for employment in a stern drive system. Like reference characters will be used where possible to facilitate clarity.

A bevel input gear 176 is mounted to the end of power shaft 150. Differential means 40 is interposed between input gear 176 and coaxial vertical drive shafts 180, 182. Differential means 40 is of the bevel gear type, and functions similarly to an automotive differential.

Differential means 40 includes a carrier 184 to which a ring gear 186 is mounted. As shown, ring gear 186 has teeth engageable with the teeth of input gear 176, so that carrier 184 is driven in response to rotation of input gear 176. A pair of differential pinions 188, 190 are mounted to a pair of pins 192, 194, respectively, extending interiorly of carrier 184. Differential pinions 188, 190 engage upper and lower bevel gears 196, 198. As shown, upper bevel gear 196 is splined to inner drive shaft 180, and lower bevel gear 198 is splined to outer drive shaft 182. Drive shafts 180, 182 are driven in the same rotational direction.

Operation of differential means 40 is as described previously.

With reference to FIG. 9, it is seen that inner shaft 180 extends downwardly throughout the gearcase housing and is fixed at its lower end to drive gear 30, which engages gear 32 to drive outer propeller shaft 18 and front propeller 22. Counterrotation is provided by means of a gear 200 fixed to the lower end of outer drive shaft 182, which engages a gear 202 fixed to the upper end of a lower vertical shaft 204. Through gear pair 32, 36 and inner propeller shaft 16, shaft 204 provides rotation to rear propeller 20 in a direction opposite that of front propeller 22. Torque splits other than 50:50 are achieved by selecting different ratios for gear pairs 30, 32 and 34, 36.

Various alternatives and modifications are contemplated as being within the scope of the following claims particularly pointing out and distinctly claiming the invention.

We claim:

1. In a marine drive for a boat, said marine drive including an engine having a rotatable output shaft, a drive unit for driving said boat in response to rotation of said output shaft, comprising:

a drive unit housing;

a first propeller shaft rotatably mounted in the lower portion of said drive unit housing;

a second propeller shaft rotatably mounted in the lower portion of said drive unit housing;

a first propeller driving by interconnected with said first propeller shaft;

a second propeller drivingly interconnected with said seond propeller shaft; and drive means disposed between said output shaft and said first and second propeller shafts for driving said first and second propeller shafts, and thereby said first and second propellers, said drive means comprising a pair of drive shafts mounted in said drive unit housing, and counterrotation drive means for driving said pair of drive shafts in opposite rotational directions in response to rotation of said output shaft, each said drive shaft being drivingly engaged with one of said propeller shafts for rotating said propeller shafts, and thereby said propellers, in opposite rotational directions, said drive means further including means for increasing or decreasing the rotational speed of one of said propellers in response to varying operating conditions, with a resulting decrease or increase in the rotational speed of the other of said propellers, so that the torque fraction supplied to each propeller is substantially constant under a range of operating conditions.

2. The drive unit of claim 1, wherein each said drive shaft extends substantially vertically within said drive unit housing so that the upper end of each said drive shaft is disposed above the waterline during boat operation, and wherein said rotational speed increasing or decreasing means is likewise disposed above the waterline.

3. The drive unit of claim 1, wherein said rotational speed increasing or decreasing means comprises:

a carrier member mounted to and rotatable with a power shaft drivingly connected to said output shaft;

a pair of drive pinions rotatably mounted to said carrier member and being rotatable therewith;

first drive gear means drivingly interposed between one of said drive pinions and a first one of said drive shafts for driving said first drive shaft in a first rotational direction;

second drive gear means including said counterrotation drive means and drivingly interposed between the other of said drive pinions and a second drive shaft for driving said second drive shaft in a second rotational direction opposite said first rotational direction;

the counterrotation of said pair of drive shafts being transferred to said first and second propeller shafts so as to provide counterrotation of said first and second propellers; and said first and second drive gear means being interconnected with each other so as to allow the rotational speed of one of said propellers to increase or decrease in response to varying operating conditions and the rotational speed of the other of said propellers to decrease or increase accordingly.

4. The drive unit of claim 3, further comprising a reversing transmission interposed between said power shaft and said carrier member for selectively imparting rotation to said carrier member in either a first or second rotational direction for selectively providing forward or reverse operation of said drive unit.

5. The drive unit of claim 4, wherein said reversing transmission comprises a first transmission gear mounted to and rotatable with said power shaft, a second transmission gear mounted for free rotation to said carrier member, drive means disposed between and engageable with said first and second transmission gears for imparting rotation to said second transmission gear in response to rotation of said first transmission gear, said first and second transmission gears rotating in opposite rotational directions, and clutch means for selectively coupling either said first or second transmission gears to said carrier member for selectively imparting rotation to said carrier member in either a first or second rotational direction.

6. The drive unit of claim 4, wherein said reversing transmission comprises a first transmission gear and a second transmission gear, said transmission gears being mounted for free rotation to said power shaft, clutch means for selectively coupling either said first transmission gear or second said transmission gear to said carrier member, and means provided between one of said first or second transmission gears and said carrier member for imparting rotation to said carrier member in an opposite rotational direction when that said transmission gear is coupled to said carrier member, for selectively imparting rotation to said carrier member in a desired rotational direction.

7. The drive unit of claim 3, wherein:

said first drive gear means comprises a first driven gear engageable with one of said drive pinions, said first driven gear being fixed to one of said drive shafts;

said second drive gear means comprises a rotatable idler gear engageable with the other of said drive pinions, and a second driven gear fixed to the other of said drive shafts and engageable with said idler gear;

said first and second drive gear means being interconnected by engagement of said pair of drive pinions with each other;

whereby rotation of said carrier member is transferred through one of said drive pinions to said first driven gear and thereby to one of said drive shafts to impart rotation to said drive shaft in a first rotational direction, such rotation of said carrier member being transferred through the other of said drive pinions and said idler gear to said second driven gear and thereby to the other of said drive shafts to impart rotation to said drive shaft in a second rotational direction opposite said first rotation direction;

so that the rotational speed of said first and second propellers is allowed to increase or decrease according to operating conditions by said pair of drive pinions rotating bout their axes, thereby providing an increase or decrease in the rotational speed of one of said drive shafts, with the rotational speed of the other of said drive shafts decreasing or increasing an amount corresponding to the increase or decrease in rotational speed of the first-mentioned of said drive shafts so as to adjust the rotational speed of the propeller to which the other of said drive shafts is connected.

8. The drive unit of claim 3, wherein:

said first drive gear means comprises a first driven gear engageable by said pair of drive pinions, said first driven gear being fixed to one of said drive shafts;

said second drive gear means comprises a rotatable idler gear engageable by said pair of drive pinions and a second drive gear fixed to the other of said drive shafts and engageable with said idler gear;

said first and second drive gear means being interconnected with each other by engagement of said first driven gear and said idler gear with said pair of drive pinions;

whereby rotation of said carrier member is transferred through said drive pinions to said first driven gear and thereby to one of said drive shafts to impart rotation to said drive shaft in a first rotational direction, such rotation of said carrier member being transferred through said drive pinions and said idler gear to said second driven gear and thereby to the other of said drive shafts to impart rotation to said drive shaft in a second rotational direction opposite said first rotational direction;

so that the rotational speed of said first and second propellers is allowed to increase or decrease according to operating conditions by said pair of drive pinions rotating about their axes so as to cause a change in rotational speed of either said first driven gear or said idler gear relative to the other, thus providing an increase or decrease in the rotational speed of one of said drive shafts as required by operating conditions so that the rotational speed of the propeller to which said drive shaft is connected is adjusted, with the rotational speed of the other of said drive shafts decreasing or increasing an amount corresponding to the increase or decrease in rotational speed of the first-mentioned of said drive shafts so as to adjust the rotational speed of the propeller to which the other of said drive shafts is connected.

9. The drive unit of claim 8, wherein said first driven gear and said idler gear are coaxial and facing, and wherein said pair of drive pinions are disposed between said facing idler gear and said first driven gear.

10. The drive unit of claim 9, wherein said idler gear is mounted to and freely rotatable on the drive shaft to which said first driven gear is fixed.

11. The drive unit of claim 9, wherein said pair of drive pinions are mounted to said carrier member by means of a pair of pins projecting from said carrier member, and wherein said pinions are disposed substantially perpendicularly relative to said drive shafts.

12. The drive unit of claim 1, wherein said counterrotation drive means includes gear means rotatable in response to rotation of said output shaft for driving said pair of drive shafts in opposite rotational directions.

13. The drive unit of claim 12, wherein said counterrotation drive means comprises a pair of gears drivingly connected to said output shaft and rotatable in response to rotation thereof, and wherein said drive means is disposed between said pair of gears.

14. The drive unit of claim 13, wherein said drive means comprises a pair of rotatable drive pinions drivingly interconnected with said output shaft and engageable with said pair of gears for driving said pair of gears in response to rotation of said output shaft, said drive means providing interconnection of said pair of drive gears so that the rotational speed of said first and second propellers is allowed to increase or decrease according to operating conditions by said pair of drive pinons rotation about their axes, thereby providing an increase or decrease in the rotational speed of one of said propeller shafts in response to operating conditions so that the rotational speed of the propeller to which said propeller shaft is connected is adjusted, with the rotational speed of the other of said propeller shafts decreasing or increasing an amount corresponding to the increase or decrease in rotational speed of the first-mentioned of said propeller shafts through said counterrotation drive means so as to adjust the rotational speed of the propeller to which the other of said propeller shafts is connected.

15. The drive unit of claim 1, wherein said rotational speed increasing or decreasing means comprises:

a carrier member rotatably supported in the upper portion of said drive unit housing, said carrier member being rotated in response to rotation of said output shaft;

a pair of drive pinions rotatably mounted to said carrier member and being rotatable therewith;

first drive gear means rotatably supported by said carrier member and drivingly engaged with a first one of said drive shafts;

second drive gear means rotatably supported by said carrier member and drivingly engaged with a tubular shaft surrounding a portion of said first drive shaft; and wherein said counterrotation drive means is disposed between said tubular shaft and the second one of said drive shafts for imparting rotation to the second one of said drive shafts in a direction opposite that of the first one of said drive shafts.

16. In a marine drive for a boat, said marine drive including an engine having a rotatable output shaft, a drive unit for driving said boat in response to rotation of said output shaft, comprising:

a drive unit housing including a lower cavity;

a first propeller shaft rotatably mounted in the lower portion of said drive unit housing;

a second propeller shaft rotatably mounted in the lower portion of said drive unit housing;

a first propeller drivingly interconnected with said first propeller shaft;

a second propeller drivingly interconnected with said second propeller shaft;

drive means disposed in said drive unit lower cavity between said output shaft and said first and second propeller shafts for driving said first and second propeller shafts, and thereby said first and second propellers, said drive means including an input shaft extending into said lower cavity and being oriented substantially perpendicularly to s aid first and second propeller shafts, and further including counterrotation drive means for driving said first and second propellers in opposite rotational directions in response to rotation of said output shaft, and further including means for increasing or decreasing the rotational speed of one of said propellers in response to varying operating conditions, with a resulting decrease or increase in the rotational speed of the other of said propellers, so that the torque fraction supplied to each propeller is substantially constant under a range of operating conditions;

wherein said first and second propeller shafts each have a portion extending into said drive unit lower cavity, and wherein said drive means is interconnected with the portion of said first and second propeller shafts extending into said cavity;

wherein said drive means comprises:

a pair of drive pinions rotatably mounted to a rotatable carrier member disposed within said drive unit lower cavity member;

a first driven gear fixed to one of said first or second propeller shafts and engageable with said drive pinions so that rotation of said carrier member is transferred through said drive pinions and said first driven gear to drive the propeller shafts to which said first driven gear is fixed in a first rotational direction;

a second driven gear fixed to the other of said propeller shafts; and said counterrotation drive means being interposed between said drive pinions and the other of said propeller shafts so that rotation of said carrier member is transferred through said drive pinions and said counterrotation drive means and said second driven gear to drive the propeller shaft to which said second driven gear is connected in a second rotational direction opposite to said first rotational direction;

said counterrotation drive means providing interconnection of said first driven gear and said second driven gear so that the rotational speed of said first and second propellers is allowed to increase or decrease according to operating conditions by said pair of drive pinions rotation about their axes, thereby providing an increase or decrease in the rotational speed of one of said propeller shafts as required by operating conditions so that the rotational speed of the propeller to which said propeller shaft is connected is adjusted with the rotational speed of the other of said propeller shafts decreasing or increasing an amount corresponding to the increase or decrease in rotational speed of the first-mentioned of said propeller shafts through said counterrotation drive means so as to adjust the rotational speed of the propeller to which the other of said propeller shafts is connected.

17. The drive unit of claim 16, wherein said counterrotation drive means comprises;

a rotatable member interconnected with said pair of drive pinions and rotatable in response to rotation of said carrier member; and stationary idler gear means disposed between and engageable with said rotatable member and second second driven gear;

so that rotation of said rotatable member is transferred through said idler gear means to said second driven gear so as to drive said second driven gear in a rotational direction opposite that of said first driven gear.

18. The drive unit of claim 17, wherein said idler gear means is maintained stationary by pin means fixed to a wall of said cavity, said idler gear means being rotatably mounted to said pin means.

19. The drive unit of claim 18, wherein said pair of drive pinions are rotatably mounted to a pair of pins connected to and extending from said carrier member.

20. The drive unit of claim 19, wherein said pair of pins to which said drive pinions are rotatably mounted extend substantially parallel to said first and second propeller shafts, and wherein said rotatable member comprises an internally toothed ring gear engaging said first driven gear and said idler gear means, and wherein said pin means to which said idler gear means is rotatably mounted is fixed to an end wall of said cylindrical cavity and extends into said cavity substantially parallel to said first and second propeller shafts.

21. The drive unit of claim 19, wherein said pair of pins to which said drive pinions are rotatably mounted extend substantially parallel to said first and second propeller shafts, and wherein said rotatable member includes an internally toothed portion and an externally toothed portion, said internally toothed portion being engageable with said pair of drive pinions and said externally toothed portion being engageable with said idler gear means, and wherein said pin means to which said idler gear means is rotatably mounted extends substantially parallel to said first and second propeller shaft and is fixed to a side wall of said cavity by means of inwardly extending pin mounting means connected to said cavity side wall.

22. The drive unit of claim 19, wherein said pair of pins to which said pair of drive pinions are rotatably mounted extend substantially perpendicular to said first and second propeller shafts, and wherein said rotatable member comprises a double faced bevel gear mounted for free rotation about one of said propeller shafts, and wherein said pin means to which said idler gear means is rotatably mounted is fixed to a side wall of said cavity and extends substantially perpendicular to said first and second propeller shafts.

* * * * *

UNITED STATES PATENT AND TRADEMARK OFFICE

CERTIFICATE OF CORRECTION

PATENT NO. : 5,009,621

DATED : April 23, 1991

INVENTOR(S) : Herbert A. Bankstahl et al

It is certified that error appears in the above-identified patent and that said Letters Patent is hereby corrected as shown below:

Claim 1, col. 8, line 63:
Delete "driving by" and substitute therefor --drivingly--.

Claim 7, Col. 10, Line 45:
Delete "bout" and substitute therefor -- about --.

Claim 8, Col 10, Lines 64 & 65:
Delete "with each other" and "first driven gear and said idler gear with said".

Claim 8, Col. 10, Line 66:
After "pinions" insert -- with each other --.

Claim 14, Col. 11, Line 57:
Delete "rotation" and substitute therefor -- rotating --.

Claim 16, Col. 13, Line 18:
Delete "rotation" and substitute therefor -- rotating --.

Signed and Sealed this

Seventeenth Day of November, 1992

*Attest:*

DOUGLAS B. COMER

*Attesting Officer*

*Acting Commissioner of Patents and Trademarks*